US005923305A

United States Patent [19]

Sadler et al.

[11] Patent Number: 5,923,305

[45] Date of Patent: Jul. 13, 1999

[54] DUAL-BAND HELIX ANTENNA WITH PARASITIC ELEMENT AND ASSOCIATED METHODS OF OPERATION

[75] Inventors: Robert A. Sadler, Durham; Gerard Hayes, Wake Forest, both of N.C.

[73] Assignee: Ericsson Inc., Research Triangle Park, N.C.

[21] Appl. No.: 08/929,592

[22] Filed: Sep. 15, 1997

[51] Int. Cl.[6] ..... H01Q 1/24; H01Q 1/36

[52] U.S. Cl. ..... 343/895; 343/702

[58] Field of Search ..... 343/895, 702, 343/900, 901, 745, 749; 455/89, 90; H01Q 1/24, 1/36

[56] References Cited

U.S. PATENT DOCUMENTS

| | | | |
|---|---|---|---|
| 4,121,218 | 10/1978 | Irwin et al. | 343/702 |
| 4,442,438 | 4/1984 | Siwiak et al. | 343/792 |
| 4,494,122 | 1/1985 | Garay et al. | 343/722 |
| 4,554,554 | 11/1985 | Olesen et al. | 343/895 |
| 4,800,395 | 1/1989 | Balzano et al. | 343/895 |
| 5,504,494 | 4/1996 | Chatzipetros et al. | 343/702 |
| 5,754,146 | 5/1998 | Knowles et al. | 343/702 |

FOREIGN PATENT DOCUMENTS

| | | |
|---|---|---|
| 0 635 898 | 1/1995 | European Pat. Off. . |
| 0 649 181 | 4/1995 | European Pat. Off. . |
| 0 790 666 | 8/1997 | European Pat. Off. . |
| 5-136623 | 6/1993 | Japan . |
| 6-37531 | 2/1994 | Japan . |
| 96/34425 | 10/1996 | WIPO . |
| 97/11507 | 3/1997 | WIPO . |
| 98/10485 | 3/1998 | WIPO . |

*Primary Examiner*—Hoanganh Le
*Attorney, Agent, or Firm*—Myers Bigel Sibley & Sajovec

[57] ABSTRACT

Antenna systems for transmitting and receiving electrical signals in two widely separated frequency bands are provided which comprise a helix antenna and a parasitic element which is adjacent to the helix antenna. The parasitic element is positioned so that when radio frequency energy in the higher of the frequency bands is incident on the antenna system, the helix antenna and the parasitic element are capacitively coupled, while when radio frequency energy in the lower of the frequency bands is incident on the antenna system, the helix antenna is substantially isolated from the parasitic element. The effective aperture of the antenna system is preferably substantially the same in both of the frequency bands of operation, and the parasitic element may be positioned either inside or outside of the helix antenna, and may be parallel to the major-axis of the helix, or alternatively, may be positioned diagonally so as to only be adjacent to two or more windings of the helix antenna. Additionally, the antenna system may be implemented in combination with a radiotelephone having a transmitter, a receiver, a user interface, and an antenna feed system.

25 Claims, 6 Drawing Sheets

DUAL-BAND HELIX ANTENNA WITH PARASITIC ELEMENT AND ASSOCIATED METHODS OF OPERATION

FIELD OF THE INVENTION

The present invention relates generally to antenna systems for radiotelephones, and, more particularly, to dual-band helix antenna systems and methods for use with portable radiotelephones.

BACKGROUND OF THE INVENTION

Radiotelephones, which are well known in the art, generally refer to communications terminals which can provide a wireless communications link to one or more other communications terminals. Such radiotelephones are used in a variety of different applications, including cellular telephone, land-mobile (e.g., police and fire departments), and satellite communications systems.

Essentially all radiotelephones include some type of antenna system for transmitting and/or receiving communications signals. Historically, monopole and dipole antennas have perhaps been most widely employed in various radiotelephone applications, due to their simplicity, wideband response, broad radiation pattern, and low cost. In particular, half-wavelength ($\lambda/2$) monopole and dipole antennas have been successfully employed in a large number of radiotelephone applications. However, as discussed below, such antennas simply are not suitable for certain radiotelephone applications.

As communications technology has matured, it has been possible to dramatically decrease the size of most radiotelephones, such that now many current radiotelephone applications are designed for mobile users who require small, handheld radiotelephones which are easily portable and which preferably fit conveniently within a user's pocket. However, traditional half-wavelength and quarter-wavelength monopole antennas are not well-suited for such applications, as the large size of these antennas with respect to the relatively small size of modern handheld transceivers makes such antennas impracticably large for use on such a handheld radiotelephone.

Helix antennas represent one potential solution to the size problem associated with monopole antennas in handheld radiotelephone applications. This class of antenna refers to antennas which comprise a conducting member wound in a helical pattern. As the conducting member is wound about an axis, the axial length of a quarter-wavelength or half-wavelength helix antenna is considerably less than the length of a comparable quarter-wavelength monopole antenna, and thus helix antennas may often be employed where the length of a quarter-wavelength monopole antenna is prohibitive. Moreover, although a half-wavelength or a quarter-wavelength helix antenna is typically considerably shorter than its half-wavelength or quarter-wavelength monopole antenna counterpart, it may exhibit the same effective electrical length.

Another advantage associated with helix antennas which makes them well-suited for many radiotelephone applications is their design flexibility. For instance, helix antennas may be designed to operate in several modes, each of which provides a different type of radiation pattern. One such mode is referred to as the "axial mode" of operation, which typically may be achieved by designing the helix antenna to have an axial length several times larger than the wavelength corresponding to the intended frequency of operation. In this mode, the helix antenna typically provides a relatively high gain radiation pattern, and this pattern may be maintained over a relatively large operating bandwidth. However, the radiation pattern provided in axial mode is highly directional and circularly polarized and hence axial mode operation is typically not appropriate for mobile radiotelephone applications, such as cellular telephone, in which the user held handsets do not track the base station antennas.

A second mode in which helix antennas may operate is referred to as normal mode. To operate in this mode, a helix antenna typically has a radiating element of resonant length (i.e., $\frac{1}{4}\lambda$, $\frac{1}{2}\lambda$, $\frac{3}{4}\lambda$ or $\lambda$ in length, where $\lambda$ is the wavelength corresponding to the center frequency of the frequency band over which the antenna is to operate) that is wound on a small diameter with a small pitch angle. Thus helix antennas which are designed to operate in normal mode are conveniently small and well-suited for various portable radiotelephone applications such as cellular telephone. In normal mode, the antenna typically provides a linearly polarized doughnut-shaped radiation pattern which is also well-suited for cellular telephone applications, but unfortunately, the antenna only provides this radiation pattern over a relatively narrow bandwidth situated about the resonant frequency. Moreover, the natural bandwidth of the antenna is proportional to the diameter of the cylinder defined by the helically wound radiating element of the antenna, and thus, all else being equal, the smaller the diameter of the antenna, the smaller the operating bandwidth.

While helix antennas, operated in either axial mode, normal mode or a proportional combination of the two, are a logical choice in many applications where a more traditional dipole or monopole antenna is too large, there are a number of radiotelephone applications which require a relatively small antenna, that is capable of transmitting and/or receiving signals in two or more widely separated frequency bands. One example application is dual-band cellular telephones, which refer to cellular phones which operate in two frequency bands, such as the 850 MHz and 1920 MHz frequency bands. Various satellite communications systems provide another example of applications requiring dual-band capability, as such systems typically have widely separated transmit and receive frequency bands. Unfortunately, however, as discussed above, helix antennas generally are not well-suited for these applications, as they typically are incapable of providing a quasi-omni-directional radiation pattern over a wide band of frequencies due to the potential bandwidth limitations of this type of antenna when operated in normal mode.

Despite the above-mentioned limitations of helix antennas, several dual-band helix antenna systems have been proposed. For instance, U.S. Pat. No. 4,554,554 to Olesen et al. discusses a quadrifilar helix antenna which includes PIN diode switches along each of its elements to provide means for selectively resonating the antenna at one of two distinct frequencies by changing the electrical length of the elements. However, the antenna disclosed in Olesen et al. does not solve the above-mentioned problem as it operates in axial mode, and hence does not provide an omni-directional radiation pattern, and any corresponding design of the antenna to operate in normal mode may be impractically large for handheld radiotelephones.

Similarly, U.S. Pat. No. 4,494,122 to Garay et al. discusses an antenna system comprising an upper radiating element and a tank circuit which resonate at one frequency, and a helical element and associated sleeve member which resonate at a second frequency. While this apparatus is potentially shorter than a conventional sleeved dipole, it is still relatively large, and the usable operating bandwidth of the antenna about each resonant frequency is very small, such that this antenna system is not suitable for many potential dual-band applications such as cellular telephone.

U.S. Pat. No. 4,442,438 to Siwiak et al. discusses an antenna system comprising two quarter-wavelength helical antenna elements and a linear conductive member, which purportedly resonates at two different frequencies. However, the antenna disclosed in Siwiak et al. does not resonate at widely separated frequencies (the resonant frequencies disclosed were 827 MHz and 850 MHz), as the antenna is designed to broaden the antennas response to cover a single bandwidth of operation as opposed to providing for operation in two widely separated frequency bands.

Finally, additional helix antenna systems are disclosed in Japanese Pat. No. 5-136623 and U.S. patent application Ser. No. 08-725507, which discuss dual band operation through use of a conductive tube, and variable pitch windings, respectively. However, the mechanism for providing dual-band operation used in both these approaches, namely coupling between adjacent windings on the helix, typically results in a narrow operating bandwidth in the higher of the frequency bands and further may provide only limited design flexibility. Moreover, the antenna discussed in Japanese Patent No. 5-136623 also has a reduced effective aperture in the higher of the frequency bands.

Thus, in light of the above-mentioned demand for dual-band radiotelephones and the problems with current antenna systems for such radiotelephones, a need exists for small, omni-directional radiotelephone antenna systems that are capable of operating in two widely separated frequency bands.

SUMMARY OF THE INVENTION

In view of the above limitations associated with existing radiotelephones, it is an object of the present invention to provide an antenna system for a dual-band radiotelephone which is sufficiently small to be employed with modern, handheld cellular telephones.

Another object of the present invention is to provide a dual-band antenna system for a radiotelephone which does not require extra circuitry to operate over both bands or to interface with the transceiver.

It is still a further object of the present invention to provide an antenna system which is capable of resonating at two or more different frequencies.

Additional objects, features and advantages of the present invention will become apparent upon reading the following detailed description and appended claims and upon reference to the accompanying drawings.

These and other objects of the present invention are provided by helix antenna systems which include a helix antenna and one or more parasitic elements positioned adjacent the helix antenna so as to cause the antenna system to resonate in at least two separate frequency bands. By advantageously positioning the parasitic elements, and by coupling only selected windings of the helix with the parasitic element, it is possible to provide a small, high performance dual-band antenna system which exhibits good impedance matching and which is relatively inexpensive to manufacture.

In a preferred embodiment of the present invention, an antenna system for transmitting and receiving electrical signals in two widely separated frequency bands is provided which comprises a helix antenna and a parasitic element which is adjacent to the helix antenna. In this embodiment of the present invention, the parasitic element is positioned so that when radio frequency energy in the higher of the frequency bands is incident on the antenna system, the helix antenna and the parasitic element are capacitively coupled, while when radio frequency energy in the lower of the frequency bands is incident on the antenna system, the helix antenna is substantially isolated from the parasitic element. Moreover, the effective aperture of the antenna system is substantially the same in both of the frequency bands.

In another embodiment of the present invention, the helix antenna may be configured to operate in normal mode, and the impedance of the antenna as seen at the antenna feed may be about 50 ohms. Additionally, the antenna system may be designed so that energy is only coupled between the helix antenna and the parasitic element at non-adjacent windings. Moreover, the antenna system may further comprise a dielectric for physically isolating the helix antenna from the parasitic element.

The helix antenna according to the present invention may also be designed to resonate independent of the parasitic element in the lower of the frequency bands. Moreover, the parasitic element may be positioned outside of the helix antenna adjacent to at least two windings of the helix antenna. Additionally, the antenna system may be implemented in combination with a radiotelephone having a transmitter, a receiver, a user interface, and an antenna feed system.

In another embodiment of the present invention, the parasitic element is positioned diagonally through the interior of the helix antenna. In this embodiment, the parasitic element may be positioned so as to be in close proximity to at least two windings on the helix antenna. In yet another embodiment, the parasitic element may be positioned outside of and adjacent to the helix antenna.

In still another aspect of the present invention, a second parasitic element may be provided adjacent to the helix antenna, wherein the second parasitic element is positioned so that when radio frequency energy in a third frequency band which is higher than the lower of the two widely separated frequency bands is incident on the antenna system, the helix antenna and the second parasitic element are capacitively coupled, while when radio frequency energy in the lower of the two widely separated frequency bands is incident on the antenna system, the helix antenna is substantially isolated from the second parasitic element.

In a preferred embodiment of the present invention, the antenna system transmits and receives electrical signals in the 824 to 894 MHz and the 1850 to 1990 MHz frequency bands. In this embodiment of the invention, the diameter of the helix antenna may be approximately 6–10 millimeters, the axial length of the helix antenna may be approximately 20–25 millimeters, and the parasitic element may be approximately 10–14 millimeters in length.

Thus, the antenna systems of the present invention provide relatively small, quasi-omni-directional antennas which are capable of operating in two or more widely separated frequency bands. This operation is achieved passively in that it does not require active switching or user input. Moreover, these antennas may be designed so as to not require any impedance matching and to effectively use the entire aperture of the antenna when operating in each frequency band of operation and, therefore, maximize the amount of signal energy transmitted and/or received by the antenna. Moreover, as the antenna systems of the present invention may be designed to only permit coupling across non-adjacent windings, it is possible to maximize the operating bandwidth of the antenna system in all the frequency bands at which the antenna is to operate.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Additionally, it will be understood by those of skill in the art that the present invention may be advantageously used in a variety of applications, and thus the present invention should not be construed as limited in any way to the example applications described herein. Like numbers refer to like elements throughout.

Figure 1:
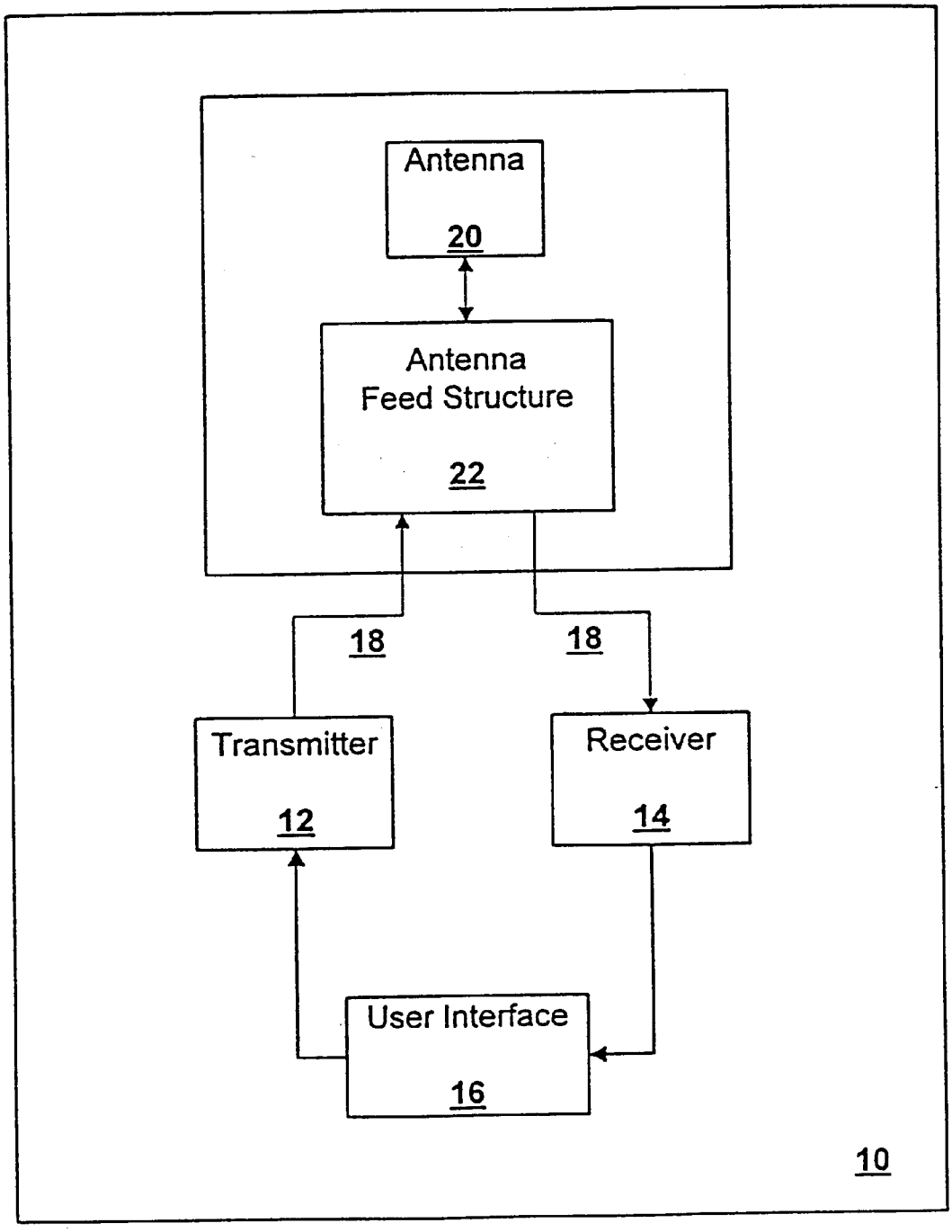
FIG. 1 is a block diagram of a dual-band radiotelephone which includes an antenna system according to the present invention.

An embodiment of a radiotelephone 10 which includes an antenna system 20 according to the present invention is illustrated in FIG. 1. Radiotelephone 10 may comprise any type of two-way wireless radio voice communications terminal, such as, for example, a satellite communications terminal, a handheld cellular telephone, or a citizens-band radio transceiver.

As shown in FIG. 1, radiotelephone 10 typically includes a transmitter 12, a receiver 14, and a user interface 16. As is well known to those of skill in the art, transmitter 12 converts the information which is to be transmitted by radiotelephone 10 into an electromagnetic signal suitable for radio communications, and receiver 14 demodulates electromagnetic signals which are received by radiotelephone 10 so as to provide the information contained in the signals to user interface 16 in a format which is understandable to the user. A wide variety of transmitters 12, receivers 14 and user interfaces 16 (e.g., microphones, keypads, rotary dials) which are suitable for use with a handheld radiotelephones are known to those of skill in the art, and such devices may be implemented in radiotelephone 10.

Figure 2:
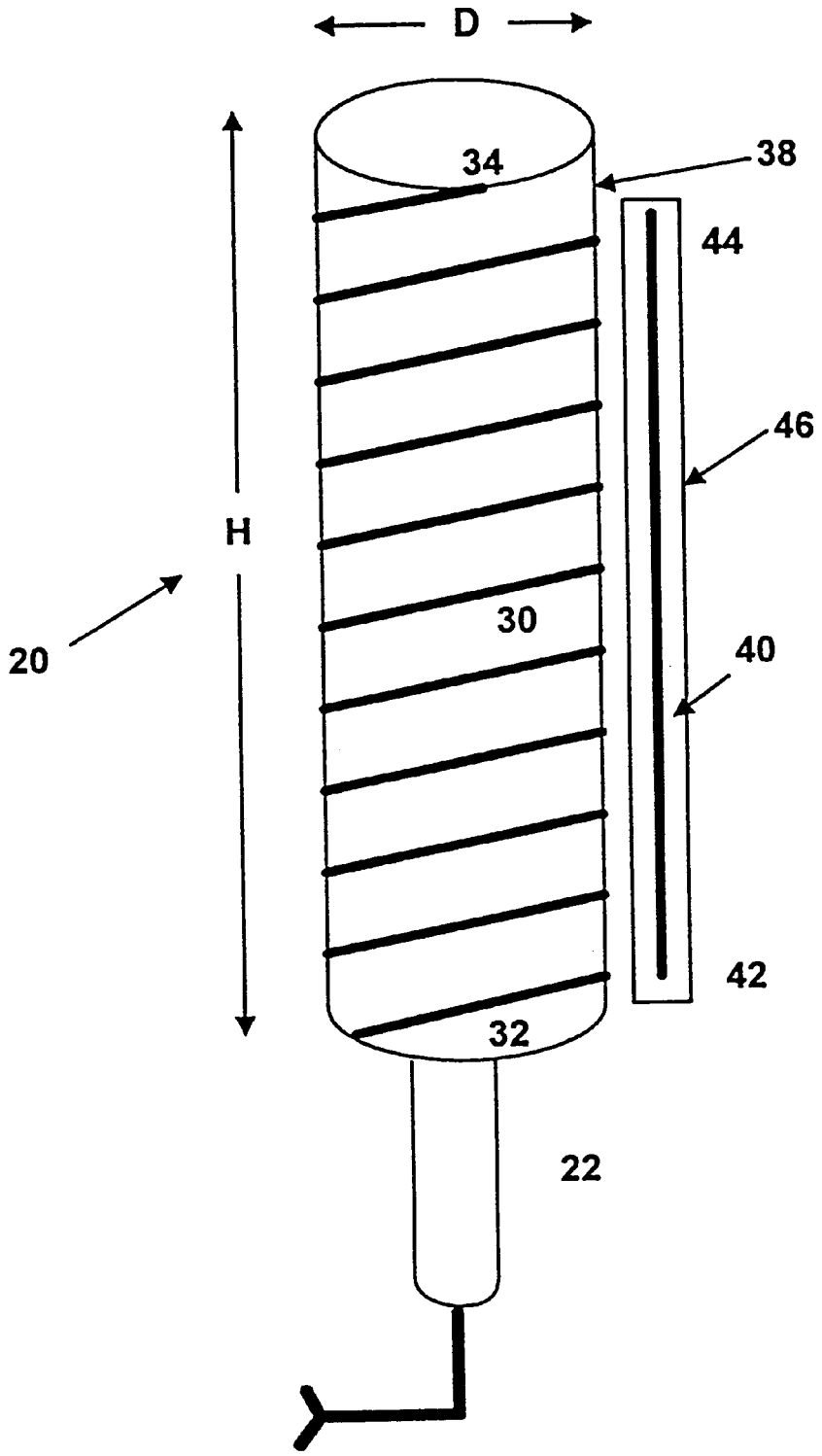
FIG. 2 illustrates a preferred embodiment of the antenna system of the present invention.

FIG. 2 depicts a preferred embodiment of the antenna system 20 of the present invention. As shown in FIG. 2, the antenna system 20 generally comprises an antenna feed structure 22, a radiating element 30, and a parasitic element 40. Moreover, antenna system 20 may additionally include a radome, which in a preferred embodiment, is a plastic tube with an end cap.

Radiating element 30 preferably comprises a continuous wire or strip of electrically conductive material, such as copper. As shown in FIG. 2, this wire or strip is wound in a helical pattern. In the embodiment depicted in FIG. 2, the origin 32 of radiating element 30 is electrically coupled to antenna feed structure 22, and the distal end 34 is open circuited. However, as will be understood by those of skill in the art, radiating element 30 need not necessarily be origin 32 fed, but may alternatively be fed from the distal end 34.

As illustrated in FIG. 2, the helix antenna of antenna system 20 has a diameter (D) corresponding to the diameter of the cylinder defined by radiating element 30, and an axial length (H) corresponding to the height of that cylinder. The antenna is further defined by the length (L) of the radiating element and the pitch angle, which is a function of the number of turns the helix rotates per unit of axial length. In the embodiment of antenna system 20 depicted in FIG. 2, radiating element 30 is wound on a small diameter with a small pitch angle, and hence is designed to operate in normal mode.

As is also illustrated in FIG. 2, radiating element 30 may be implemented by winding the conductive wire or strip in a helical pattern along the length of a coaxial supporting tube 38. However, as will be understood by those of skill in the art, a coaxial supporting tube 38 is not required, as the antenna may be implemented as a self-supporting conducting wire or strip 30 wound in a helical pattern. Where the radiating element 30 is implemented as a strip of conducting material, preferably a relatively wide strip (e.g., on the order of 3–5 millimeters wide for an antenna designed to operate in the 1500–1660 MHz frequency range) is used in order to reduce the loss and to minimize the inductance associated with radiating element 30, thereby facilitating matching the impedance of antenna 20 to the impedance of transmitter 12 and receiver 14.

As will also be understood by those of skill in the art, radiating element 30 need not be a true helix in the sense that it maintains a constant diameter throughout its coaxial length. To the contrary, alternative embodiments which are within the scope of the present invention include radiating elements 30 which are helical in the sense that they form a coil or part coil around an axis, but also change in diameter from one end to the other. Thus, while the preferred embodiment of antenna system 20 has a radiating element 30 which defines a cylindrical envelope, it is possible to implement antenna system 20 to have a radiating element 30 which instead defines a conical envelope or another surface of revolution.

The radiation pattern provided by the helix antenna of antenna system 20 is primarily a function of the helix diameter (D), pitch angle and element length (L). In a preferred embodiment of the present invention, the electrical length of radiating element 30 is approximately $\lambda/4$, $\lambda/2$, $3\lambda/4$ or $\lambda$ (where $\lambda$ is the wavelength corresponding to the center frequency of the lower of the frequency bands in which the antenna is to operate), as such an antenna operates at resonance in the lower of the operating frequency bands. However, as will be understood by those of skill in the art in light of the present disclosure, the helical portion of antenna system 20 need not be designed to be naturally resonant in the lower of the frequency bands in which the antenna is to operate, as multiple parasitic elements may be used to create multiple points of resonance, such that it is not necessary that radiating element 30 resonate in one of the bands of operation. Moreover, as discussed herein, it may be desirable to operate using a radiating element of length $\lambda/4$, as opposed to some other multiple of a quarter wavelength, as the impedance of a radiating element of this length (which typically is on the order of 50 ohms) may be more readily matched to the impedance of the source transmission line 18.

Furthermore, as will also be understood by those of skill in the art, the actual physical length of radiating element 30 may be appreciably shortened due to radome effects, as the radome tends to change the velocity of propagation such that the length is shorter than in free space. Such an effect is advantageous where smaller size is an important goal, and, thus, it will be understood that antenna system 20 of the present invention may also be operated at or near resonance with a radiating element 30 having a physical length which is not a quarter-wavelength multiple. Moreover, while helix antennas with elements of actual or electrical (where radome effects apply) length $\lambda/4$, $\lambda/2$, $3\lambda/4$ and $\lambda$ are known to operate at resonance, such resonant or near resonant operation may also be obtained with radiating elements 30 of other lengths through the use of additional matching means, thereby providing for good power transfer between the source and the load. Accordingly, it should be recognized that the present invention is not limited to helix antennas with radiating element lengths which are multiples of a quarter wavelength.

As is also illustrated in FIG. 2, antenna system 20 includes a parasitic element 40, which is located adjacent, but not in direct electrical contact with, the radiating element 30. Parasitic element 40 may comprise any electrically conductive material which is placed in the vicinity of radiating element 30. In a preferred embodiment of the present invention, parasitic element 40 comprises a non-resonant conductive wire or strip, the ends 42, 44 of which are in close proximity to the windings of the helix. In the embodiment of the present invention illustrated in FIG. 2, parasitic element 40 is located just outside, and parallel to, the cylinder defined by the windings of radiating element 30, with end point 44 adjacent to the last winding on the distal end of radiating element 30 and end point 42 adjacent to the last winding on the origin end of radiating element 30.

As is also illustrated in FIG. 2, parasitic element 40 is preferably isolated from radiating element 30 by a dielectric material 46, such as TEFLON, polycarbonate, polyeurethane or the like, which serves to prevent parasitic element 40 from coming into direct electrical contact with radiating element 30 and also may help in maintaining the optimal spacing between parasitic element 40 and radiating element 30. In a preferred embodiment, parasitic element 40 is implemented as a conducting wire or strip molded in a plastic casing. However, as will be understood by those of skill in the art, a dielectric material buffer 46 is not required.

Antenna system 20 operates as follows. When electromagnetic signals in the lower of the frequency bands in which the radiotelephone 10 is to operate are incident on antenna system 20, radiating element 30 operates in resonant mode (in the case where radiating element 30 is of resonant length for signals in the lower frequency band), providing for communications in this frequency band. Moreover, by carefully selecting the distance between ends 42, 44 of parasitic element 40 and radiating element 30, antenna system 20 may be designed so that at these lower frequencies, the signal incident on the radiating element 30 does not readily couple to the parasitic element 40, but instead remains predominately, or preferably exclusively, in radiating element 30. At the higher band of operation, however, capacitive coupling between radiating element 30 and parasitic element 40 increases significantly, such that energy is coupled from the radiating element 30 to parasitic element 40 and then back to radiating element 30 along a path that bypasses one or more of the windings of the helix. Thus some of the energy in the higher frequency band which are incident on antenna system 20 experience a shortened electrical path due to capacitive coupling effects, providing a second effective resonant frequency for antenna system 20.

The above capacitive coupling effects can best be understood with reference to the reactance equation for a capacitor, which is:

$$X_c=1/j2\pi fC$$

where f is the operating frequency and C is the capacitance. This equation shows that the reactance of a capacitor (in this case parasitic element 40) becomes smaller with increasing frequency, and thus the capacitive coupling to parasitic element 40 is substantially increased at higher frequencies. Consequently, it is possible to design antenna system 20 so that parasitic element 40 is substantially isolated from radiating element 30 at lower frequencies, but is capacitively coupled to radiating element 30 in higher frequency ranges.

As will be understood by those of skill in the art, the amount of capacitive coupling which occurs with signals in the higher frequency band depends primarily upon the distance between parasitic element 40 and the windings of radiating element 30. In a preferred embodiment of the present invention, this distance is selected so that some, but not substantially all, of the energy in the higher frequency band of operation incident on radiating element 30 is capacitively coupled to parasitic element 40. Thus, in this embodiment, parasitic element 40 does not act as a true electrical short, but instead creates a "distributive impedance" whereby the energy is divided between radiating element 30 and parasitic element 40 for the windings spanned by parasitic element 40. Thus, the entire structure which comprises antenna system 20 radiates when operating in both the lower and the higher frequency bands, and as such, the effective aperture of antenna system 20 is substantially the same in both the lower and higher frequency bands. This advantageously allows antenna system 20 to maximize the receive signal when operating in the upper of said frequency bands, as all the windings of the antenna are used in transmitting and receiving electrical signals in that frequency band.

Moreover, as discussed above, in a preferred embodiment of the present invention, radiating element 30 is a quarter-wavelength helix which may be designed to have a natural impedance on the order of 50 ohms, and hence is inherently matched to the 50 ohm coaxial connection 18 which is commonly used on radiotelephones 10 to couple transmitter 12 and receiver 14 to antenna system 20. Additionally, according to the teachings of the present invention it will also be understood that the physical distance between ends 42 and 44 of parasitic element 40 and the individual windings of radiating element 30 may be adjusted to optimize the performance of antenna system 20 in terms of the frequencies at which the antenna resonates, the voltage standing wave ratio achieved across each of the separate frequency bands of operation, and the impedance of antenna system 20 as viewed at the antenna feed system 22.

Thus, the antenna system depicted in FIG. 2 is a relatively small, quasi-omni-directional antenna, which is capable of operating in two or more widely separated frequency bands (where as used herein, the term widely separated refers to frequency bands separated by at least 30% the center frequency of the lower of the frequency bands). Moreover, this antenna advantageously does not require any impedance matching, and as the entire antenna radiates in both frequency bands, its effective aperture is substantially the same regardless the frequency of operation and the antenna thus maximizes the amount of signal energy transmitted and/or received by the antenna.

Figure 3:
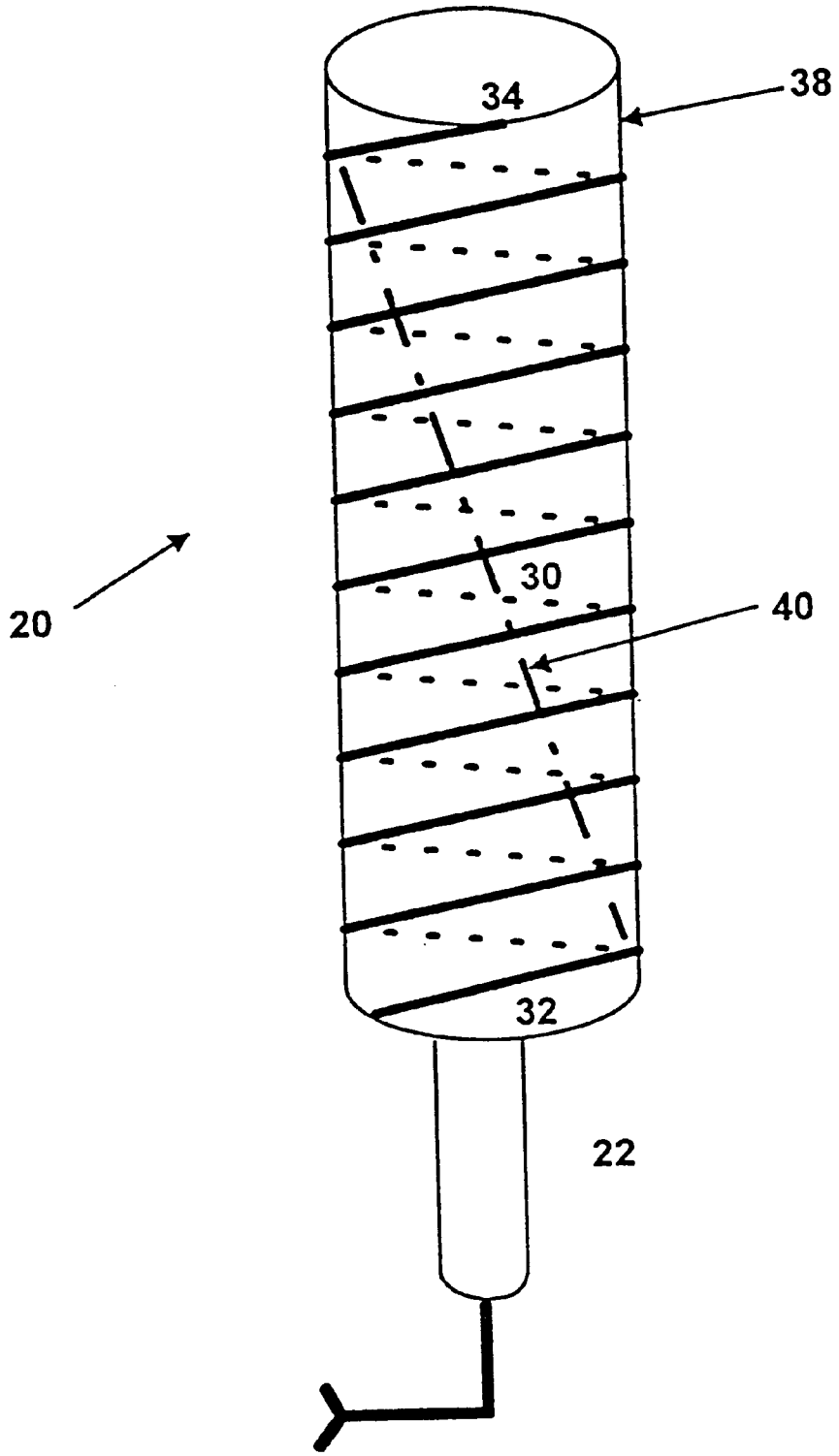
FIG. 3 illustrates an alternative embodiment of the antenna system of the present invention.

FIG. 3 illustrates an alternative embodiment of the antenna system of the present invention. In this embodiment, parasitic element 40 is located within the interior of the helix formed by radiating element 30, and is positioned diagonally so as to extend from the upper left side to the lower right side of the helix. In this embodiment, parasitic element 40 is in close proximity to at least two points on the helix (the left side of the last winding on the distal end of radiating element 30 and the right side of the winding adjacent the origin end of radiating element 30), and, thus, parasitic element 40 provides coupling between non-adjacent windings on the helix.

As will be understood by those of skill in the art in light of the present disclosure, allowing for coupling between non-adjacent windings provides a significant increase in design flexibility, as it allows for optimization across the entire radiating structure. Thus the antenna designs of the present invention may use this increased flexibility to aid in matching the impedance of antenna system 20 to the impedance at the antenna feed network 22, and to maximize the operating bandwidth of the antenna system in all the frequency bands at which the antenna is to operate. Moreover, according to the teachings of the present invention, parasitic element 40 may be positioned so as to be in close proximity to no more than two of the windings on the helix. Such an arrangement may advantageously simplify manufacture of the antenna system.

Figure 4:
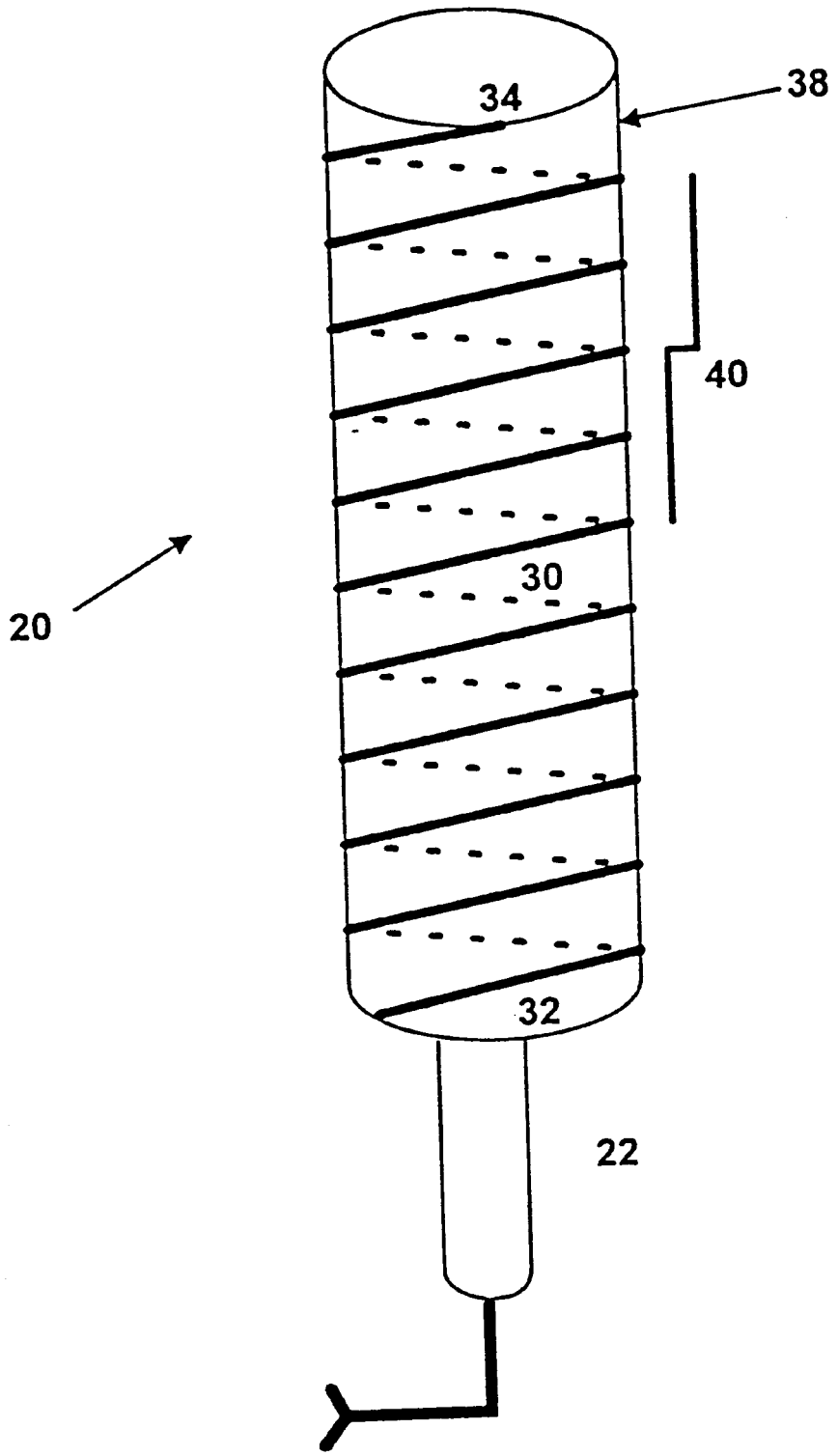
FIG. 4 illustrates an alternative embodiment of the antenna system of the present invention.

Another embodiment of the antenna system of the present invention is illustrated in FIG. 4. In this embodiment, parasitic element 40 is non-linear, and is located outside the helix formed by radiating element 30 in a position parallel to the major axis of the helix. Due to the non-linear design, parasitic element 40 is located close to several windings on the helix, while being further spaced from others.

Figure 5:
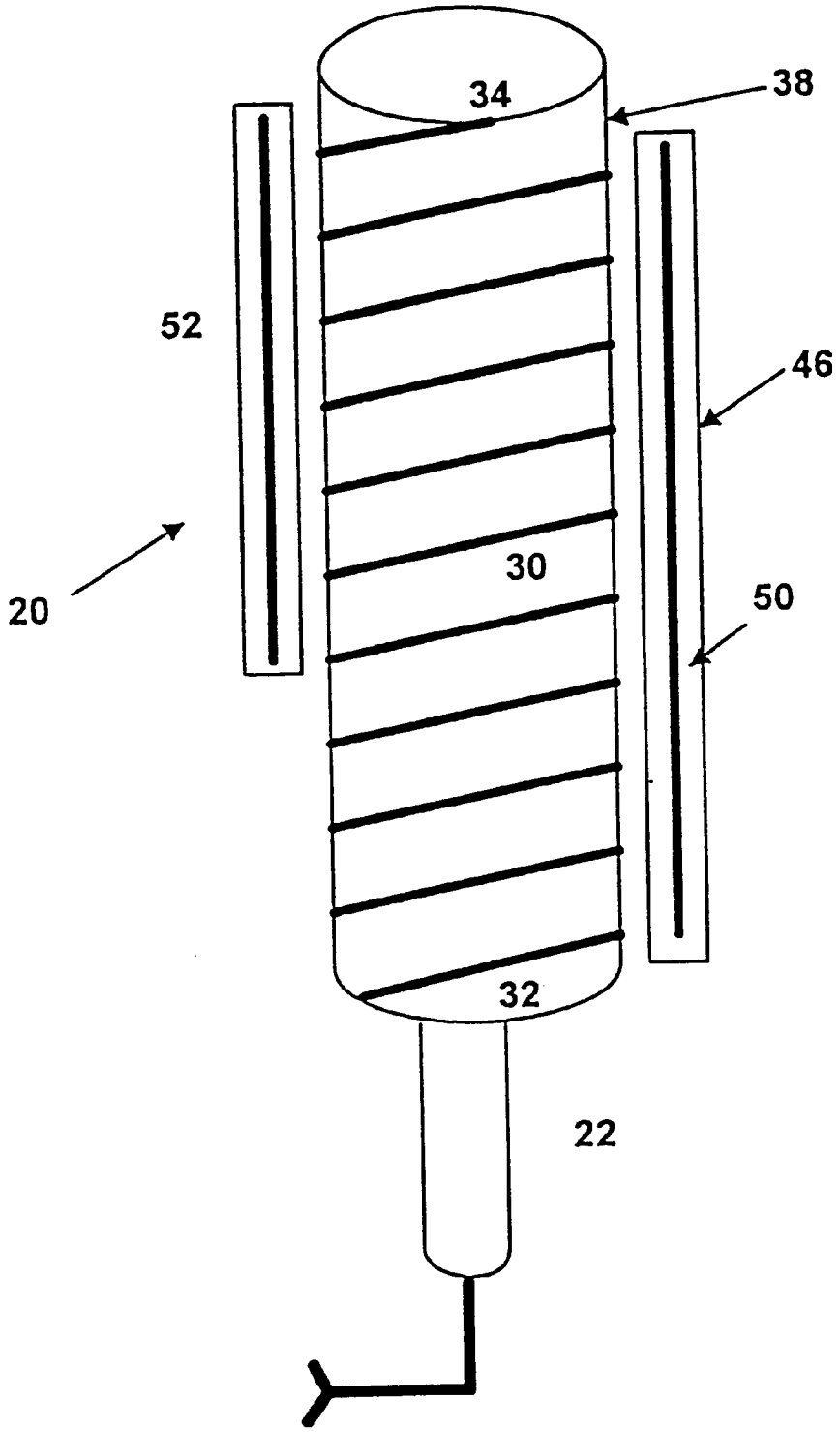
FIG. 5 illustrates an alternative embodiment of the antenna system of the present invention.

Moreover, according to the teachings of the present invention, antenna system 20 may include multiple parasitic elements to provide for operation in more than two separate frequency bands. FIG. 5 illustrates such an embodiment of antenna system 20 which is designed to operate in up to three widely separated frequency bands. As shown in FIG. 5, antenna system 20 includes a first parasitic element 50 located outside and parallel to the major axis of the helix formed by radiating element 30, and a second, shorter, parasitic element 52 located in the same orientation on the opposite side of the helix. In this embodiment, radio frequency energy incident on radiating element 30 which is in the highest of the three frequency bands at which the antenna is to operate is capacitively coupled to and from the first parasitic element 50 and the second parasitic element 52, so that the energy is divided between radiating element 30 and first and second parasitic elements 50, 52 in such a way that the capacitively coupled combination of radiating element 30 and first and second parasitic elements 50, 52 resonate in the highest of the frequency bands at which antenna system 20 is to operate. Similarly, radio frequency energy incident on radiating element 30 which is in the middle of the three frequency bands at which the antenna is to operate is capacitively coupled to and from at least one of the first and second parasitic elements 50, 52, so that the energy is divided between radiating element 30 and at least one of first and second parasitic elements 50, 52 in such a way that the capacitively coupled combination of radiating element 30 and at least one of first and second parasitic elements 50, 52 resonates in the middle of the three frequency bands at which antenna system 20 is to operate. However, when radio frequency energy in the lowest of the frequency bands at which the antenna is to operate is incident on radiating element 30, such energy does not readily couple to either of the first or second parasitic elements 50, 52 and instead remains substantially isolated therefrom. However, as radiating element 30 is designed to resonate in the lowest of the three frequency bands, radiating element 30 acting alone works to transmit and/or receive signals in the lowest of the frequency bands at which the antenna is to operate.

As discussed above, in a preferred embodiment of antenna system 20, the impedance of the antenna is approximately 50 ohms as viewed at the antenna feed circuitry 22. Such an impedance may be achieved by implementing radiating element 30 as a quarter-wavelength helix and by selecting the location and length of parasitic element 40. In a preferred embodiment of the present invention, antenna system 20 is coupled to transmitter 12 and receiver 14 via a coaxial connection 18, which typically exhibits an impedance on the order of 50 ohms. Thus, in this embodiment it is possible to achieve maximum power transfer without the need for impedance matching networks, as the impedance of antenna system 20 is matched to the impedance of the source transmission line 18. However, as will be understood by those of skill in the art, impedance matching networks are well known in the art for transforming the impedance of an antenna to match the impedance of a source transmission line. Accordingly, antennas designed according to the present invention need not be designed to have an impedance on the order of 50 ohms, although antennas with impedances in this range typically have the advantage of not requiring the additional hardware associated with an impedance matching network.

Pursuant to the teachings of the present invention, it will be understood that the parasitic element may be placed in a variety of different locations adjacent to the helix antenna and at a variety of different orientations. The optimum location and orientation, however, may vary significantly with the specific size and performance requirements specified for the antenna system. Accordingly, the flexibility available with the antenna systems of the present invention for positioning the parasitic element provides the designer several degrees of freedom when attempting to design an antenna that provides acceptable VSWR and bandwidth performance, resonates in two or more specific frequency bands and meets user-imposed size and volume constraints. This design flexibility is very important as the permissible size and volume of the antenna are often very constrained due to aesthetic considerations and user demand for small radiotelephones.

In another aspect of the present invention, methods of making antenna system 20 are disclosed. According to this aspect of the invention, antenna system 20 for communicating in two separate frequency bands is provided by providing a radiating element 30 and a parasitic element 40 which is located adjacent to radiating element 30. The parasitic element 40 is positioned so that when radio frequency energy in the higher of the frequency bands is incident on the antenna system 20, the radiating element 30 and the parasitic element 40 are capacitively coupled, while when radio frequency energy in the lower of the frequency bands is incident on the antenna system 20, the radiating element 30 is substantially isolated from the parasitic element 40. As will be understood by those of skill in the art in light of the present disclosure, the diameter for the radiating element may, in a preferred embodiment, be chosen as the largest diameter helix antenna which will fit within the volume allowed for antenna system 20. The length of radiating element 30 may be chosen as the length corresponding to a resonant length for the antenna, which in a preferred embodiment, is one quarter the wavelength of the center frequency of the lower of the frequency bands of operation. The axial length of antenna system 20 may be selected as the length allowed for antenna system 20 in the design specifications.

In one embodiment of the present invention, the optimum position for the parasitic element may be determined by providing radio frequency energy to antenna system 20 and measuring the output of antenna 20 using a network analyzer when parasitic elements 40 of various size are placed at various positions and orientations adjacent radiating element 30. By this method, the size, location and orientation of parasitic element 40 may be selected so as to provide an antenna system 20 which meets specified size, VSWR and frequency response requirements. In a preferred embodiment of the present invention, the parasitic element 40 is positioned so that the effective aperture of the antenna system 20 is substantially the same in both of the frequency bands in which it is to operate.

EXAMPLE 1

An antenna system 20 has been constructed according to the teachings of the present invention for operation in the 824 MHz to 894 MHz AMPS frequency band and in the 1850 MHz to 1990 MHz PCS frequency band. In this embodiment of the present invention radiating element 30 comprises a copper strip wound approximately 6 turns on a fiberglass tube, where the length of radiating element 30 is approximately 88 millimeters (a quarter-wavelength at 850 MHz), the axial length is on the order of 25 millimeters and the diameter of the helix is approximately 8 millimeters. In this embodiment, parasitic element 40 was implemented as a 13 millimeter long non-resonant conductive wire which was positioned outside, but adjacent to (approximately 0.2 millimeters of separation), the helix formed by radiating element 30 in a position parallel to the major axis of the helix. The parasitic element 40 includes a dielectric coating 46 around the outside surface of the wire. In this embodiment of the present invention, the parasitic element 40 was positioned by wrapping one of its ends one or two turns around radiating element 30 approximately one-and-a-half windings up from the origin 32 of radiating element 30, and wrapping the other end of parasitic element 40 one or two turns around radiating element 30 approximately four-and-a-half windings up from the origin 32. In this embodiment, the dielectric coating 46 surrounding parasitic element 40 touches both of the intermediate windings of radiating element 30 (i.e., the windings between the windings where parasitic element 40 is wrapped around radiating element 30).

EXAMPLE 2

A second antenna system 20 has been constructed according to the teachings of the present invention which also was designed for operation in the 824 MHz to 894 MHz AMPS frequency band and in the 1850 MHz to 1990 MHz PCS frequency band. In this embodiment radiating element 30 comprises a copper strip wound approximately five-and-a-half turns on a fiberglass tube, where the length of radiating element 30 is approximately 88 millimeters (a quarter-wavelength at 850 MHz), the axial length is on the order of 20 millimeters and the diameter of the helix is approximately 7 millimeters. In this embodiment, parasitic element 40 was implemented as a 10 millimeter long non-resonant conductive wire which was positioned outside, but adjacent to (approximately 0.2 millimeters of separation), the helix formed by radiating element 30 in a position parallel to the major axis of the helix. The parasitic element 40 included a dielectric coating 46 around the outside surface of the wire. In this embodiment of the present invention, the parasitic element 40 was positioned by wrapping one of its ends one or two turns around radiating element 30 approximately one-and-a-half windings up from the origin 32 of radiating element 30, and wrapping the other end of parasitic element 40 one or two turns around radiating element 30 approximately four-and-a-half windings up from the origin 32.

Figure 6:
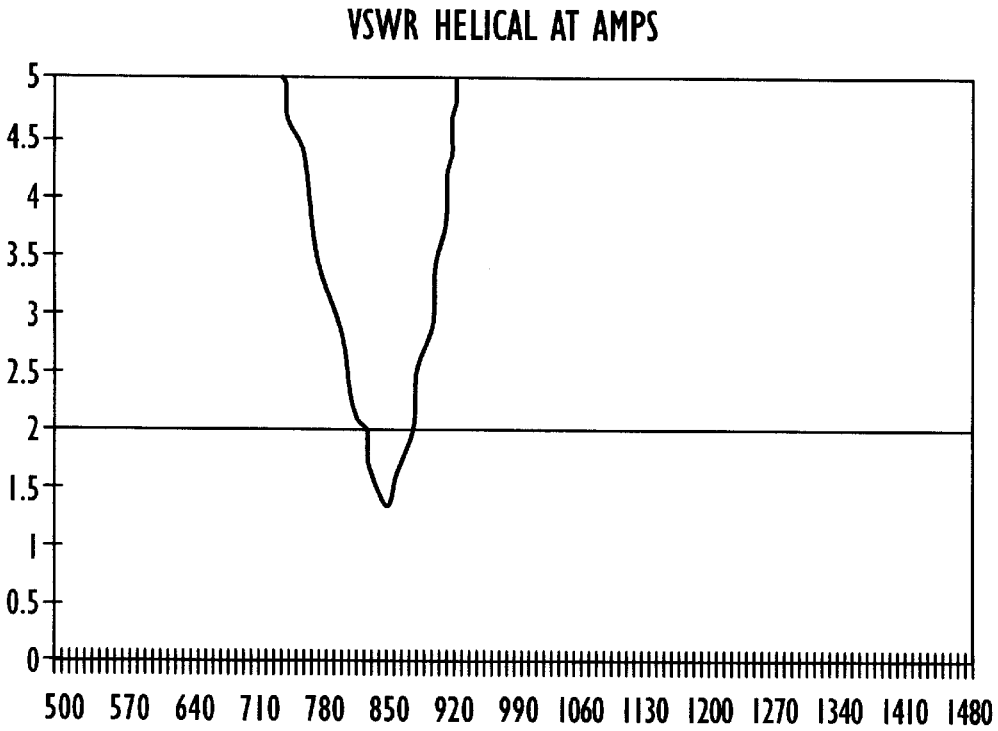
FIG. 6 illustrates the performance of a preferred embodiment of the antenna system of the present invention in the lower (850 MHz) frequency band.
Figure 7:
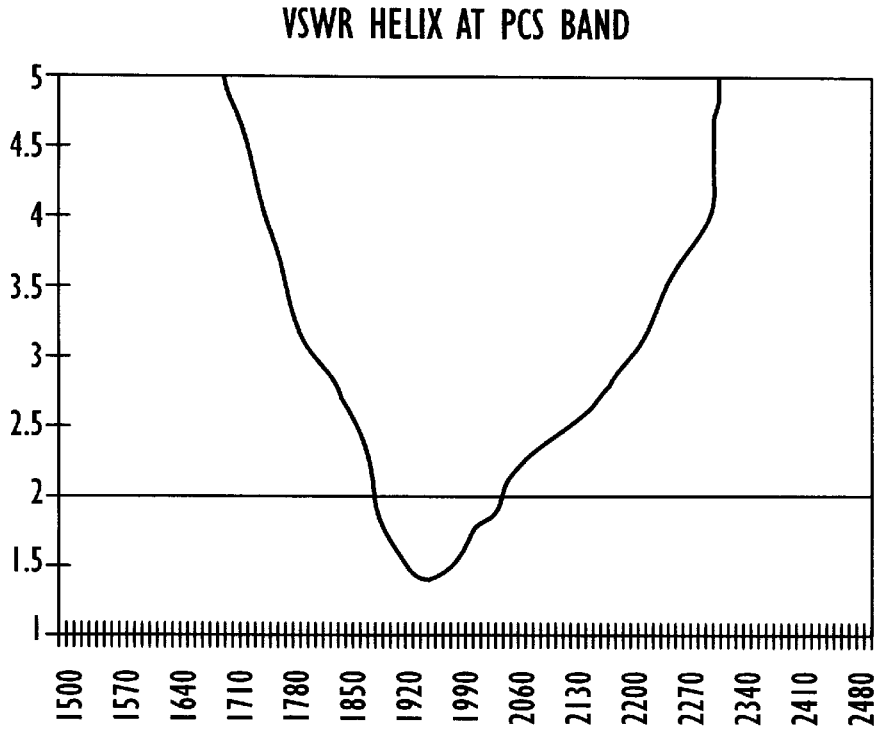
FIG. 7 illustrates the performance of a preferred embodiment of the antenna system of the present invention in the higher (1920 MHz) frequency band.

FIGS. 6 and 7 illustrate the response of this antenna system 20 over both of the frequency bands of operation. As illustrated in FIG. 6, antenna system 20 provides a VSWR of less than 2.0 over the frequency range of 824 to 894 MHz, and FIG. 7 shows that a VSWR of less than 2.5 is similarly maintained over the frequency range of 1850 to 1990 MHz. Thus, the antenna system provides for dual-band operation over both the AMPS and PCS frequency bands.

In the drawings, specification and examples, there have been disclosed typical preferred embodiments of the invention and, although specific terms are employed, these terms are used in a generic and descriptive sense only and not for purposes of limitation, the scope of the invention being set forth in the following claims. Accordingly, those of skill in the art will themselves be able to conceive of embodiments of the dual-band antenna systems and radiotelephones and associated methods other than those explicitly described herein without going beyond the scope of the present invention.

That which is claimed is:

1. An antenna system for transmitting and receiving electrical signals in two widely separated frequency bands, comprising:

a helix antenna having a single helix element; and a parasitic element positioned diagonally through the interior of said helix element;

wherein said parasitic element is positioned so that when radio frequency energy in the higher of said frequency bands is incident on said antenna system, said helix element and said parasitic element are capacitively coupled, while when radio frequency energy in the lower of said frequency bands is incident on said antenna system, said helix element is substantially isolated from said parasitic element.

2. The antenna system of claim 1, wherein said parasitic element is in close proximity to no more than two windings on said helix element.

3. The antenna system of claim 1, wherein the effective aperture of said antenna system is substantially the same in both of said frequency bands.

4. The antenna system of claim 1, wherein said helix element is configured to operate in normal mode.

5. The antenna system of claim 1, wherein the impedance as seen at an antenna feed is on the order of 50 ohms.

6. The antenna system of claim 1, wherein energy is only coupled between said helix element and said parasitic element at non-adjacent windings.

7. The antenna system of claim 1, further comprising a dielectric for physically isolating said helix element and said parasitic element.

8. The antenna system of claim 1, wherein said helix element resonates independent of said parasitic element in the lower of said frequency bands.

9. The antenna system of claim 1 in combination with a radiotelephone having:

a transmitter;

a receiver;

a user interface; and an antenna feed system.

10. The antenna system of claim 1, wherein the effective aperture of said antenna system is substantially the same in both of said frequency bands.

11. A dual-band antenna system for transmitting and receiving electrical signals in the 824 to 894 MHz and the 1850 to 1990 MHz frequency bands, comprising:

a helix antenna having a single helix element designed to resonate in the 824 to 894 MHz frequency band; and a parasitic element adjacent to said helix element which is sized and positioned so that when said antenna system operates in the 1850 to 1990 MHz frequency band, radio frequency energy incident on said helix element is capacitively coupled to and from said parasitic element, while when said antenna system operates in the 824 to 894 MHz frequency band, radio frequency energy incident on said helix element is substantially isolated from said parasitic element.

12. The antenna system of claim 11, wherein the diameter of said helix element is approximately 6 to 10 millimeters and the axial length of said helix element is approximately 20 to 25 millimeters.

13. The antenna system of claim 12, wherein said parasitic element is approximately 10 to 14 millimeters in length, and wherein at least a portion of the parasitic element is positioned approximately 0.2 millimeters from the helix element.

14. The antenna system of claim 11, wherein said parasitic element is positioned outside of said helix element adjacent to at least two windings of said helix element, and wherein at least a portion of the parasitic element is positioned approximately 0.2 millimeters from the helix element.

15. The antenna system of claim 11, wherein energy is only coupled between said helix element and said parasitic element at non-adjacent windings.

16. The antenna system of claim 11, further comprising a dielectric for physically isolating said helix element and said parasitic element, wherein a portion of the parasitic element is wrapped around at least one winding of the helix element.

17. The antenna system of claim 11, further comprising a second parasitic element adjacent to said helix element, wherein said second parasitic element is sized and positioned so that when radio frequency energy in a third frequency band which is higher than the lower of said two widely separated frequency bands is incident on said antenna system, said helix element and said first and second parasitic elements are capacitively coupled, while when radio frequency energy in the lower of said two widely separated frequency bands is incident on said antenna system, said helix element is substantially isolated from said second parasitic element.

18. The antenna system of claim 11 in combination with a radiotelephone having:

a transmitter;

a receiver;

a user interface; and an antenna feed system.

19. A method of making an antenna system for communicating in two separate frequency bands, the method comprising the steps of:

providing a helix antenna having a single helix element;

providing a parasitic element adjacent to the helix element;

sizing and positioning the parasitic element so that when radio frequency energy in the higher of the frequency bands is incident on the antenna system, the helix element and the parasitic element are capacitively coupled, while when radio frequency energy in the lower of the frequency bands is incident on the antenna system, the helix element is substantially isolated from the parasitic element and so that the effective aperture of the antenna system is substantially the same in both of the frequency bands.

20. The method of claim 19, wherein the helix element is configured to operate in normal mode.

21. The method of claim 19, wherein the helix element resonates independent of the parasitic element in the lower of the frequency bands.

22. A method of receiving signals using a dual-band antenna system comprising a helix antenna having a single helix element and a parasitic element positioned adjacent the helix element, the method comprising the steps of:

receiving signals via the helix element in a first frequency band that corresponds to the resonant frequency of the helix element while substantially isolating the parasitic element from the helix element; and receiving signals via the combination of the helix element and the parasitic element in a second frequency band which is higher than the first frequency band.

23. The method of claim 22, wherein the step of receiving signals via the combination of the helix element and the parasitic element further comprises the step of receiving signals via the combination of the helix element and the parasitic element in a second frequency band which is higher than the first frequency band while only coupling energy between the helix element and the parasitic element at non-adjacent windings.

24. The method of claim 22, wherein the antenna system further comprises a dielectric for physically isolating said helix element and said parasitic element, and wherein a portion of the parasitic element is wrapped around at least one winding of the helix element.

25. A method of making an antenna system for communicating in two separate frequency bands, the method comprising the steps of:

providing a helix antenna having a single helix element;

providing a parasitic element adjacent to the helix element;

positioning the parasitic element diagonally through the interior of the helix element so that when radio frequency energy in the higher of the frequency bands is incident on the antenna system, the helix element and the parasitic element are capacitively coupled, while when radio frequency energy in the lower of the frequency bands is incident on the antenna system, the helix element is substantially isolated from the parasitic element and so that the effective aperture of the antenna system is substantially the same in both of the frequency bands.

* * * * *